US008851535B2

(12) United States Patent
Miskel et al.

(10) Patent No.: US 8,851,535 B2
(45) Date of Patent: Oct. 7, 2014

(54) SECURITY DEVICE FOR A DOUBLE DOOR

(75) Inventors: Hugh Michael Miskel, Marietta, GA (US); John Tyler Willis Hagler, Durham, NC (US); Patrick Brian Murphy, Cary, NC (US)

(73) Assignee: Mountain View Promotions, Inc., Marietta, GA (US)

( * ) Notice: Subject to any disclaimer, the term of this patent is extended or adjusted under 35 U.S.C. 154(b) by 0 days.

(21) Appl. No.: 13/421,580

(22) Filed: Mar. 15, 2012

(65) Prior Publication Data

US 2012/0235427 A1 Sep. 20, 2012

Related U.S. Application Data

(60) Provisional application No. 61/452,659, filed on Mar. 15, 2011.

(51) Int. Cl.
*E05C 19/18* (2006.01)

(52) U.S. Cl.
CPC ..... *E05C 19/186* (2013.01)
USPC ..... 292/288; 292/258; 70/14; 70/238

(58) Field of Classification Search
None
See application file for complete search history.

(56) References Cited

U.S. PATENT DOCUMENTS

| | | | | | |
|---|---|---|---|---|---|
| 181,716 | A | * | 8/1876 | Read | 411/280 |
| 390,130 | A | * | 9/1888 | Longenecker | 292/292 |
| 898,685 | A | * | 9/1908 | ritter | 292/291 |
| 2,928,512 | A | * | 3/1960 | Slater et al. | 403/22 |
| 3,383,130 | A | | 5/1968 | Avila | |
| 3,664,164 | A | * | 5/1972 | Zaidener | 70/202 |
| 3,843,178 | A | | 10/1974 | Eskoff | |
| 4,012,065 | A | | 3/1977 | Miller | |
| 4,082,334 | A | | 4/1978 | Volta et al. | |
| 4,334,705 | A | | 6/1982 | Rumph | |
| 4,372,136 | A | * | 2/1983 | Mickelson | 70/14 |
| 4,702,037 | A | | 10/1987 | Hollowell et al. | |
| 4,955,648 | A | | 9/1990 | Miller | |
| 5,152,564 | A | | 10/1992 | Martineau | |
| D334,703 | S | | 4/1993 | Murphy | |
| 5,217,267 | A | * | 6/1993 | Yagi | 292/338 |
| D345,091 | S | | 3/1994 | Malone | |
| 5,294,160 | A | | 3/1994 | Arthur | |
| 5,381,679 | A | * | 1/1995 | Cummins | 70/209 |
| 5,462,323 | A | * | 10/1995 | Benninger | 292/292 |
| 5,501,493 | A | | 3/1996 | Arthur | |
| 5,664,815 | A | | 9/1997 | Kornder | |
| 5,836,186 | A | * | 11/1998 | Winner, Jr. | 70/209 |
| D418,038 | S | | 12/1999 | Scott | |

(Continued)

*Primary Examiner* — Kristina Fulton
*Assistant Examiner* — Thomas Neubauer
(74) *Attorney, Agent, or Firm* — Jason A. Bernstein; Barnes & Thornburg LLP

(57) ABSTRACT

A security device for a double door, including a first locking portion having a curved portion and an elongated male portion, and a second locking portion having a curved portion and an elongated female portion. A lock mechanism includes a pair of rows of teeth having a gap therebetween and associated with the bottom side of the male portion and a locking prong mounted to the female portion. The locking prong has a flexible finger portion that terminates in a T-shaped end. The finger portion can slide between the gap in the rows of teeth. A release button mounted on the female portion, when pressed, causes the locking prong to bend downward, disengaging the T-shaped end from between the teeth and allowing the first and second locking portions to separate, thereby unlocking the security device.

1 Claim, 13 Drawing Sheets

(56) References Cited

U.S. PATENT DOCUMENTS

| | | | | |
|---|---|---|---|---|
| 6,018,968 | A | 2/2000 | Sides | |
| 6,401,503 | B1 * | 6/2002 | Lin | 70/209 |
| 6,725,695 | B2 * | 4/2004 | Vito | 70/209 |
| 6,755,450 | B1 * | 6/2004 | Chen | 292/295 |
| 7,344,167 | B2 | 3/2008 | Johnson et al. | |
| 8,313,128 | B2 * | 11/2012 | Belyea et al. | 292/288 |
| 2006/0272365 | A1 * | 12/2006 | Copus | 70/14 |
| 2006/0290145 | A1 * | 12/2006 | Rasmussen et al. | 292/274 |

* cited by examiner

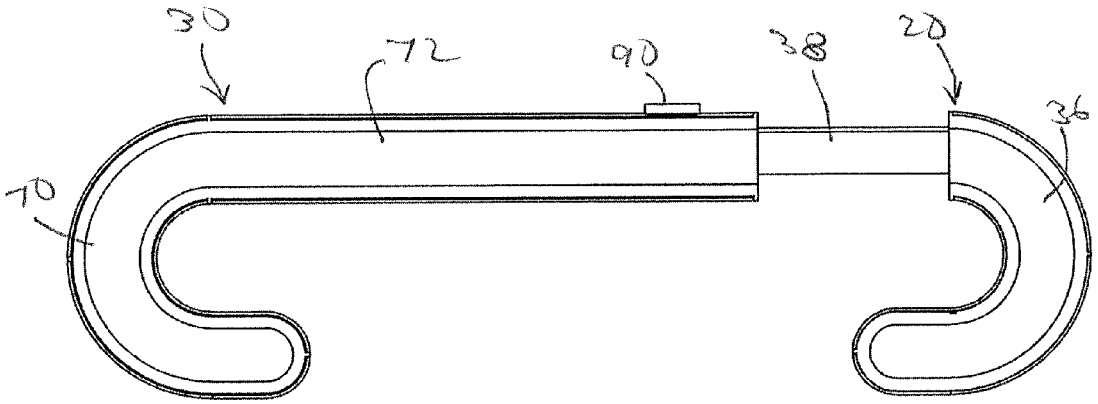
*Fig.* 4
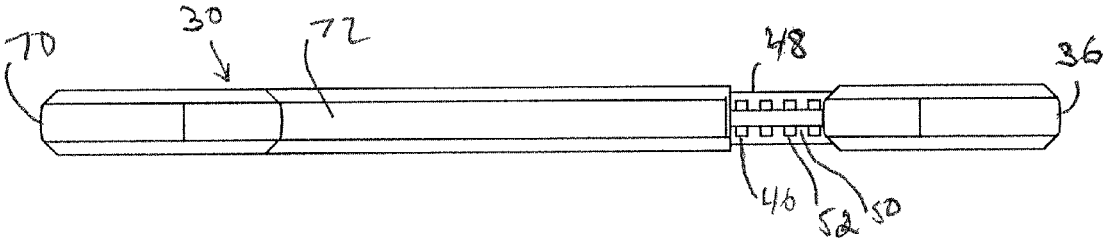
*Fig.* 5

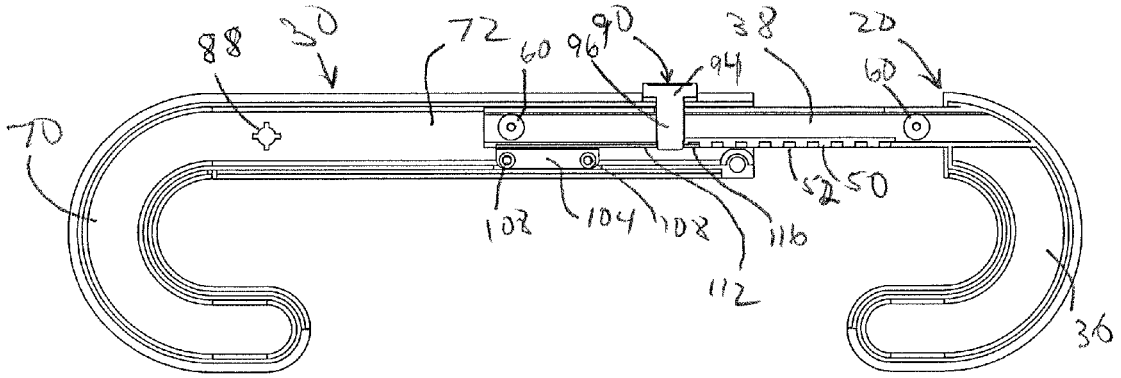
*Fig.* 6
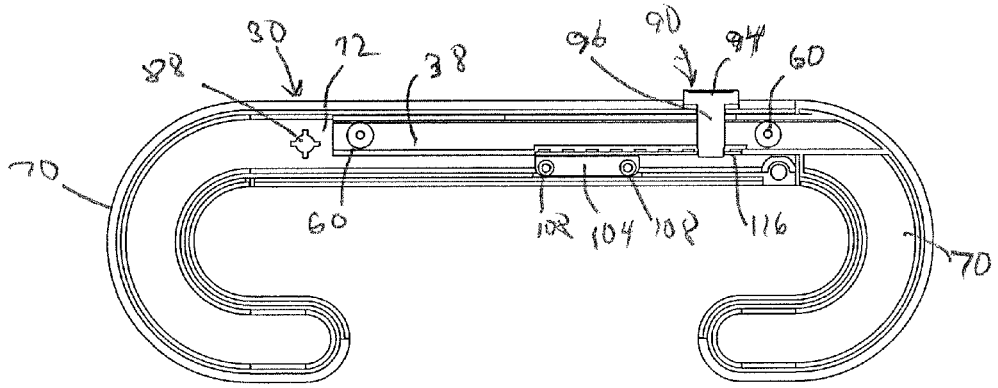
*Fig.* 7

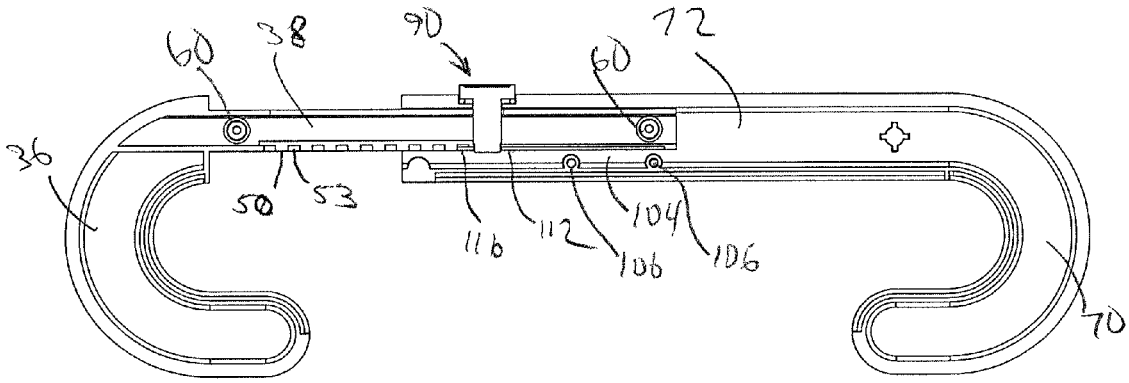
*Fig.* 8
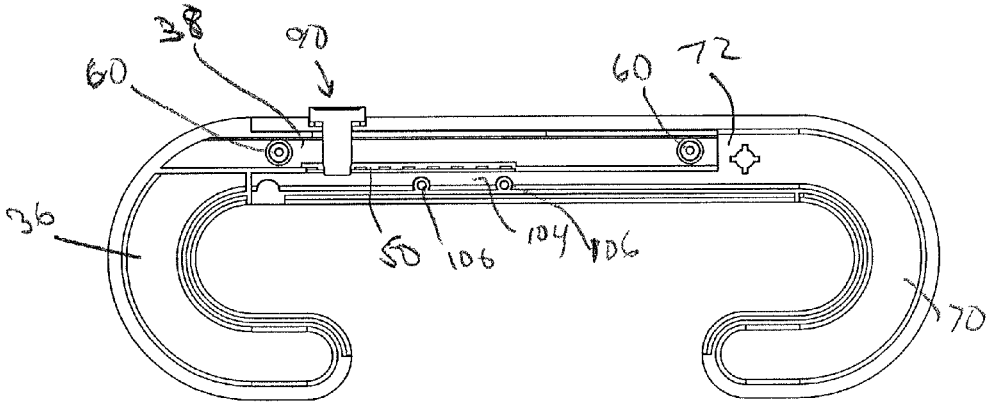
*Fig.* 9

SECURITY DEVICE FOR A DOUBLE DOOR

CROSS-REFERENCE TO RELATED APPLICATION

This application claims benefit of U.S. provisional patent application No. 61/452,659, filed Mar. 15, 2011, entitled Double Door Guard Protection Device, and commonly assigned to the assignee of the present application, the disclosure of which is incorporated by reference in its entirety herein.

FIELD

The present disclosure relates to door security devices and locks, and, more particularly to a security device for a double "French" door.

BACKGROUND

Typical residential swinging (as compared to sliding) doors are either a single door or a double door, the latter often being known as a "French" door. A single door is the more secure of the two types of traditional doors, but single doors are still vulnerable based on the weak door frame construction.

A double door typically has a first door that can be unlockably secured to the door frame with pins in the top and bottom of the door that enter the door frame. A second door is locked in place by a traditional door lock and/or a deadbolt that interacts with a striker plate in the first door. The second door is difficult to secure because there is no door jam to aid in reinforcement.

It would be desirable to have a security device for a double door that can withstand substantial force (e.g., forced entry level force), yet be easily attached or removed. Such a door security device would be conveniently storable. It would also provide a shape that is aesthetically pleasing and that would not be overly prominent in presence.

SUMMARY

Generally described, the present disclosure provides in a first exemplary embodiment a security device for a double door, the door having a first door and a second door, each door having a set of hinges and a door handle or knob, the security device comprising, a first locking member having a first side having at least one first attachment post, a second side having at least one attachment aperture, at least one fastener that can pass through an attachment aperture and secure to an attachment post, a first curved portion formed by a portion of the first and second sides, an elongated male portion having a top side and a bottom side, the bottom side having a first row of teeth and a second row of teeth associated therewith, there being a gap between the first and second rows of teeth forming a channel therethrough; a second locking member connectable to the first locking member and having a first side having at least one first attachment post, second side having at least one attachment aperture, at least one fastener that can pass through an attachment aperture and secure to an attachment post, a second curved portion formed by a portion of the second locking member first and second sides, an elongated female portion having a top side containing a slotted aperture and a channel sized to accommodate the first locking member elongated male portion; a button adapted to slide within the second locking member elongated female portion slotted aperture, the button having a top first portion and an elongated post extending downward therefrom, the post terminating in a connector portion; and, a locking prong having a base portion adapted to be connected to the second locking member and further having a finger portion including an elongated slot and a T-shaped distal end, whereby the finger portion elongated slot is sized to accept the connector portion of the post, wherein the first locking member male portion is adapted to be received and slide within the second locking member female portion such that when the security device is in a locked configuration the locking prong can slidingly fit within the gap between the first and second rows of teeth in the elongated male portion and such that the distal end of the locking prong can fit between two adjacent teeth in neighboring rows of teeth, thereby preventing movement of the first and second locking members with respect to each other, and, when the security device is in an unlocked configuration achieved by pressing the button which causes the locking prong finger portion to flex downward and the distal end disengages from between the rows of teeth to permit sliding relative movement of the first and second locking members, thereby permitting disengagement of the security device from either or both door handles.

Another aspect of the present disclosure provides an apparatus for controllably preventing or permitting access to a room or chamber, comprising: a first door and a second door, each having a door handle, knob or pocket, as described hereinabove, and a security device as described herein.

Another aspect of the present disclosure provides a method of securing a double door having a first and a second door, each door having a door handle or pocket, comprising: providing a security device as described herein; closing the first and second doors; pressing the release button to expand the security device; mounting the security device on the first and second doors such that the first locking portion engages the first door handle or pocket and the second locking portion engages the second door handle or pocket; pressing the release button to collapse the security device so that the first and second locking portions move toward each other; and, releasing the release button to maintain the first and second locking portions in a locked relative position.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which:

FIG. 4 is a left side elevational view of the exemplary embodiment of FIG. 1 in an extended configuration.

FIG. 5 is a bottom plan view of the exemplary embodiment of FIG. 1 in an extended configuration.

FIG. 6 is a left side elevational cutaway view of the exemplary embodiment of FIG. 1 in an extended configuration.

FIG. 7 is a left side elevational cutaway view of the exemplary embodiment of FIG. 1 in a contracted configuration.

FIG. 8 is a right side elevational cutaway view of the exemplary embodiment of FIG. 1 in an extended configuration.

FIG. 9 is a right side elevational cutaway view of the exemplary embodiment of FIG. 1 in a contracted configuration.

DETAILED DESCRIPTION

Figure 1:
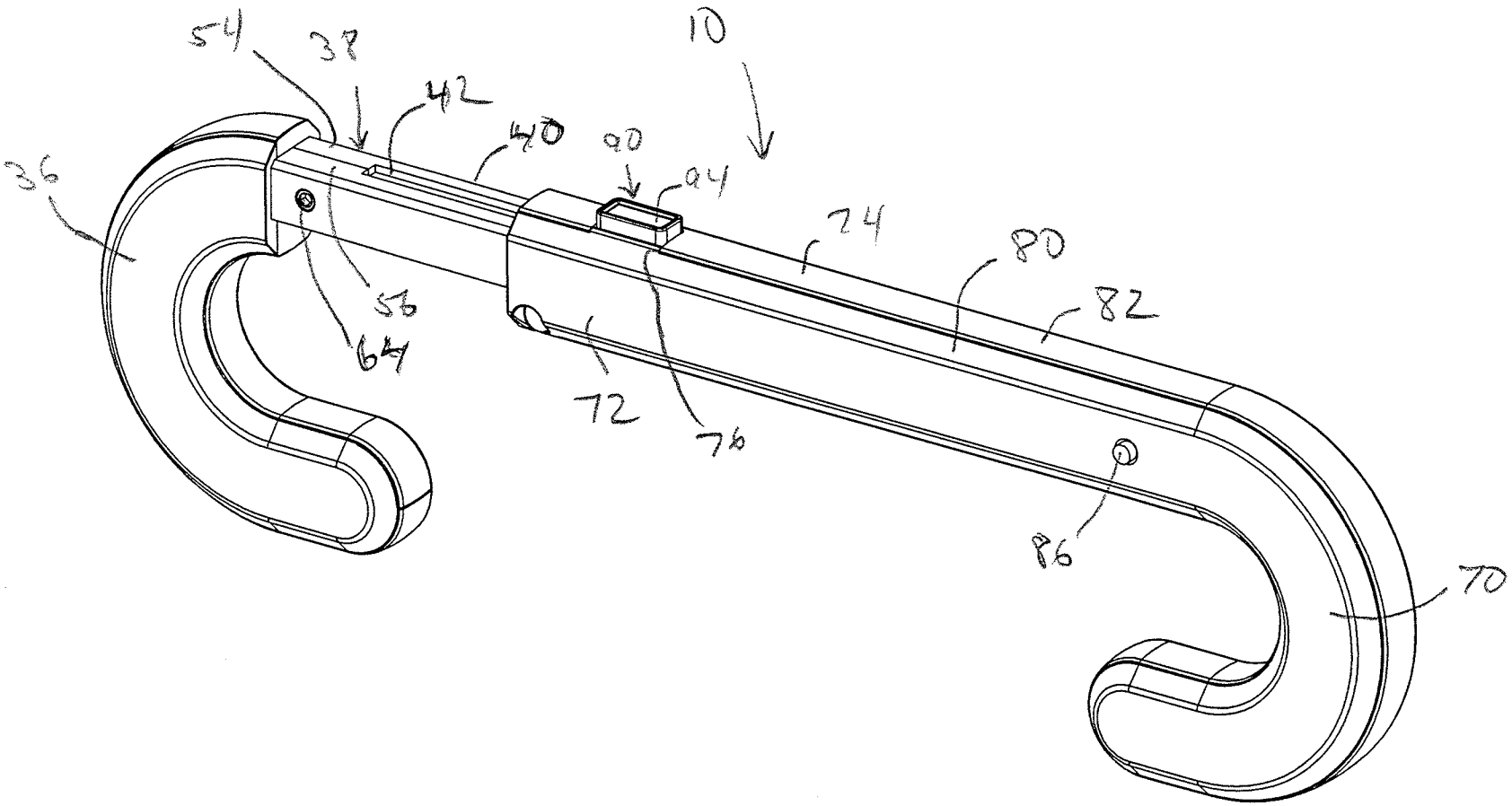
FIG. 1 is a perspective view in partial cutaway of one exemplary embodiment of the present disclosure.

FIG. 1 shows a first exemplary embodiment of a security device 10 of the present disclosure. The security device 10 generally comprises a first locking member 20, a second locking member 30, a locking prong 100, and a prong release button 90.

Figure 10:
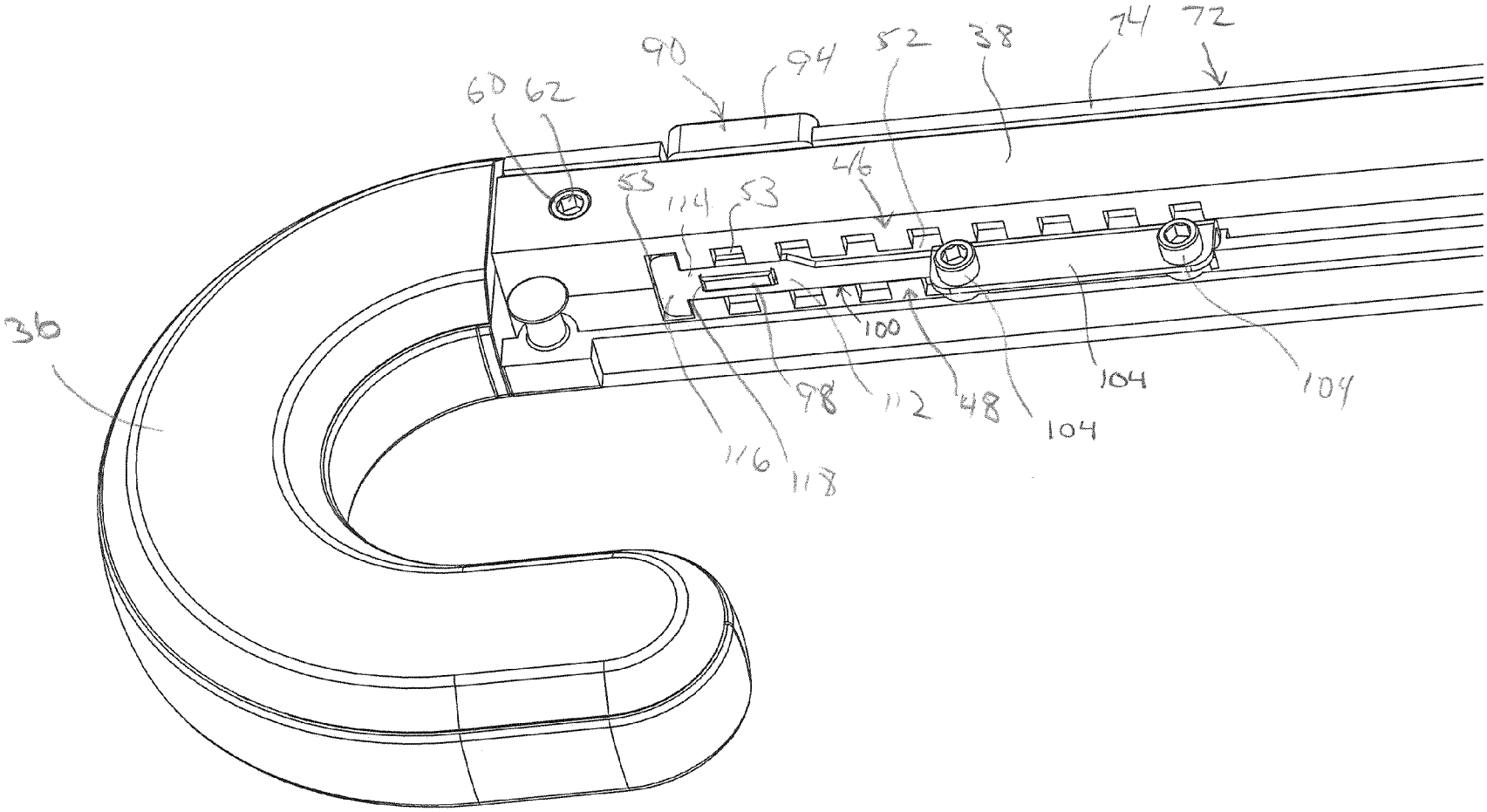
FIG. 10 is a detail perspective view of a portion of an exemplary embodiment of FIG. 1 showing the bottom of the male member and female member and illustrating the engagement of the locking prong with the teeth.

The first locking member 20 comprises a first generally U-shaped curved portion 36 and an elongated male portion 38 extending from one end of the curved portion 36. The male portion 38 has a top 40 having an elongated slot 42 formed therein. The male portion 38 further has a bottom 44 that includes two opposing rows 46, 48 of teeth 50 separated by a gap 52. The space between adjacent teeth 50 defines a notch 53, as shown in FIG. 10.

Figure 2:
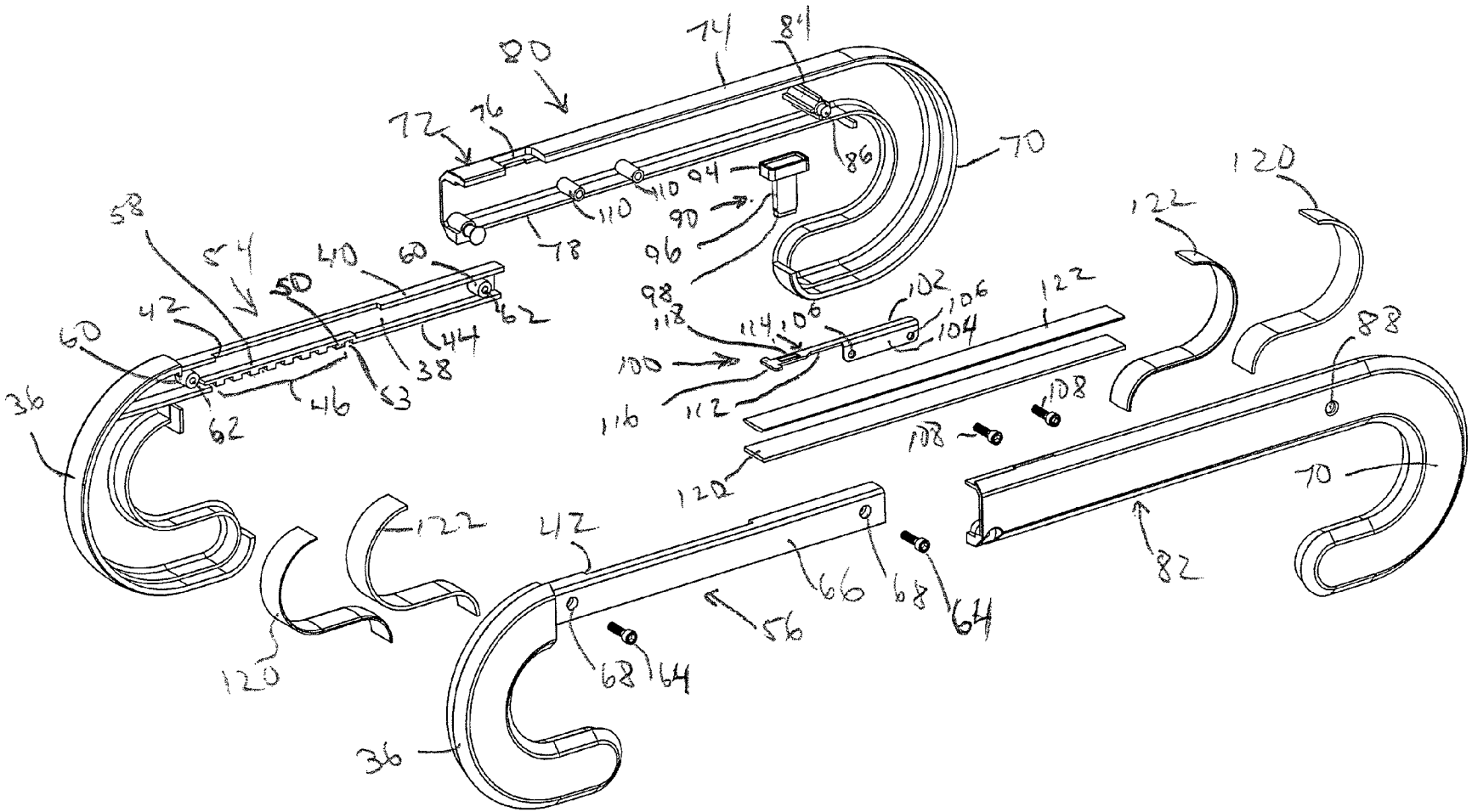
FIG. 2 is an exploded view of the exemplary embodiment of FIG. 1.
Figure 3:
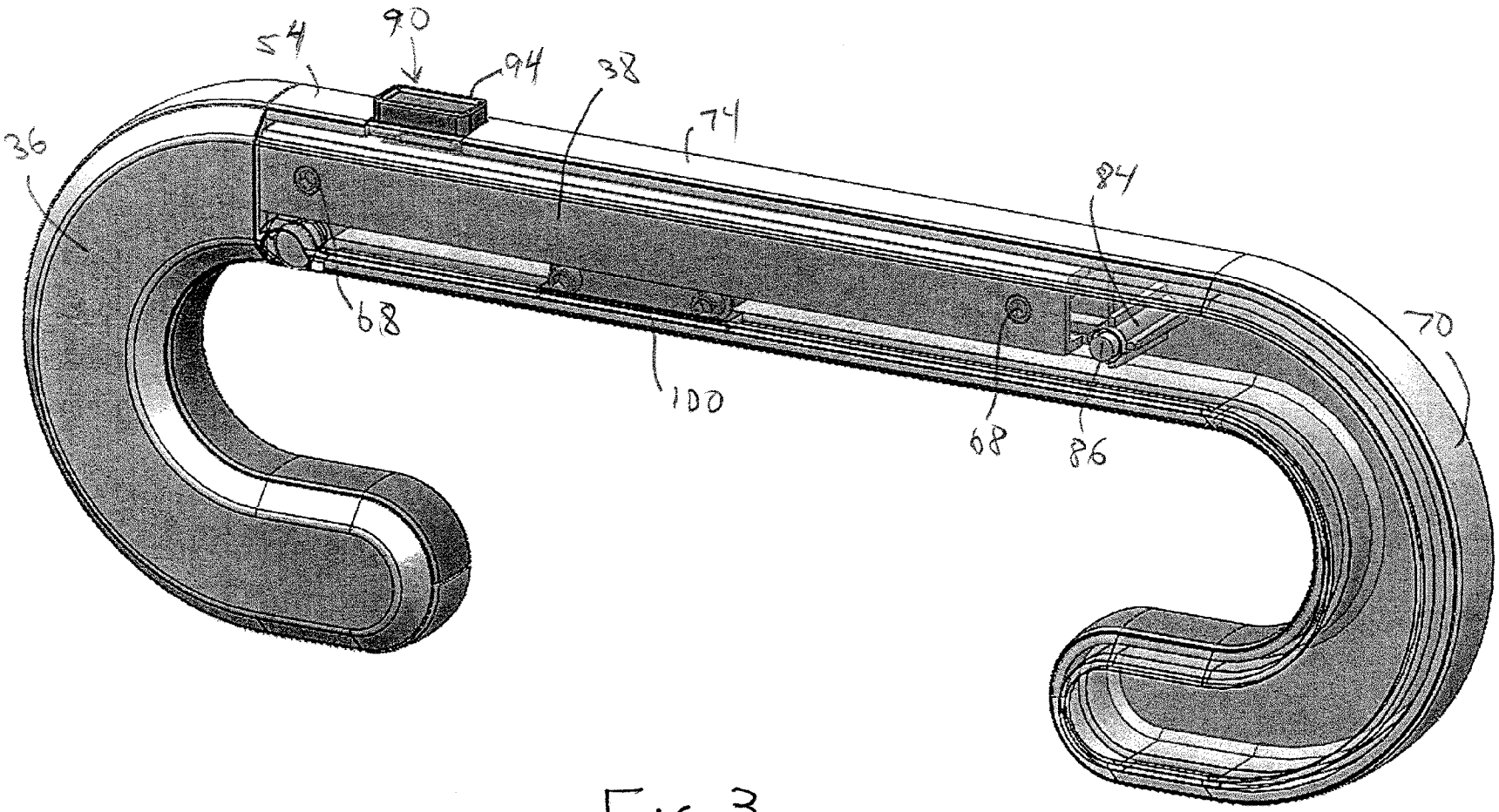
FIG. 3 is a perspective view, in partial cutaway, of the exemplary embodiment of FIG. 1.

The first locking member 20 may be made from a first piece 54 and a second piece 56, as shown in FIGS. 2-3. The first piece 54 has a bottom 58 containing one row 46 of teeth 50. The first piece 54 has at least one, and, as shown in FIG. 2, two stems 60, each having a hole 62 therein which can receive a fastener 64. The second piece 56 has a bottom 65 having a row of teeth 48. The second piece 56 has a side 66. For each stem 60 the side 66 has one aperture 68 through which the fastener can 64 pass. The first piece 54 and second piece 56 may be joined by snap-fitting or otherwise aligning the two pieces and attaching the fasteners 64 through the aperture 68 in the side and into the stem holes 62. In one exemplary embodiment the fasteners 64 are threaded and the stem holes 62 have internal threads.

The second locking member 30 comprises a first generally U-shaped curved portion 70 and an elongated female portion 72 extending from one end of the curved portion. The female portion 72 has a top 74 having a slot 76 formed therein. The slot 76 can accommodate the release button, as described in further detail herein below. The female portion 72 further has a bottom 78.

The second locking member 30 may be made from a first piece 80 and a second piece 82, as shown in FIG. 2. The first and second pieces 80, 82 are configured to be joined together, such as by a snap fit, glue, welding, or the like. In one exemplary embodiment the first 80 piece may have a stem 84 terminating in a protrusion 86 that can be force fitted into a hole 88 in the second piece 82. In one exemplary embodiment the first piece 80 may further have a second stem terminating in a protrusion that can be force fitted into a hole in the second piece. Alternatively (and not shown), the stems may each have a bore at least partially therein that can receive a fastener through a hole in the second piece. The second piece further has at least one and preferably two stems each having a hole defined therein.

FIGS. 4-9 show various views of a security device 10 according to one exemplary embodiment. A prong release button 90 has a contact portion 94 and a post portion 96, the post portion 96 slidingly being received within the slot 76 in the second locking member female portion 72. The post portion 96 terminates in an end portion 98.

The locking prong 100 has an attachment portion 102 that may have a flange 104 having at least one hole 106 defined therein. The attachment portion 102 can be attached to the second locking member 30 by a fastener 108 passing through the hole and fastening to a post 110. The locking prong 100 also has a finger portion 112 having a distal end 114 terminating in a T-shaped end 114. The T-shaped end 114 can fit in a notch 53 in each row of teeth 46, 48, as shown in FIG. 10. The finger portion 112 also has a slot 118 defined therein sized to accommodate the end portion 98 of the release button post 96. In one exemplary embodiment the end portion 98 is deformed slightly and force fitted into the slot 76 such that the end portion 98 is retained in the slot 76. The finger portion 112 has a width that is able to fit between the two rows of teeth 46, 48 in the first locking member male portion 38, as shown in FIGS. 10-12.

The first and second locking members 20, 30 may be made of any suitable material that is generally rigid and has requisite strength, such as, but not limited to, metal, plastic, composite, combinations of the foregoing or the like. In one exemplary embodiment, as shown in FIG. 2, a plastic insert 120 and a rubber insert 122 can be incorporated into the U-shaped curve of the curved portions 36, 70 of the first and second locking members 20, 30. Similarly, a plastic insert 120 and a rubber insert 122 can be incorporated into the second locking member female portion 72. The locking prong 100 may be made of a material having requisite strength and sufficient flexibility to bend slightly; the material may be metal, plastic, combinations thereof, or the like.

Figure 13:
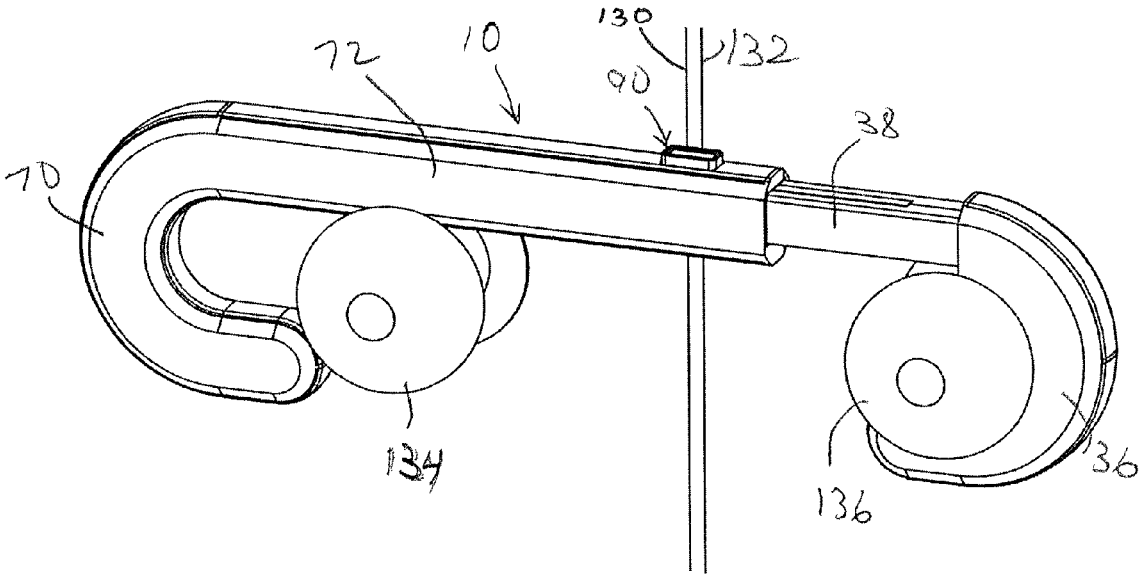
FIG. 13 is a perspective view of a security device according to one exemplary embodiment of the present disclosure in a extended position ready to engage a set of double door handles.
Figure 14:
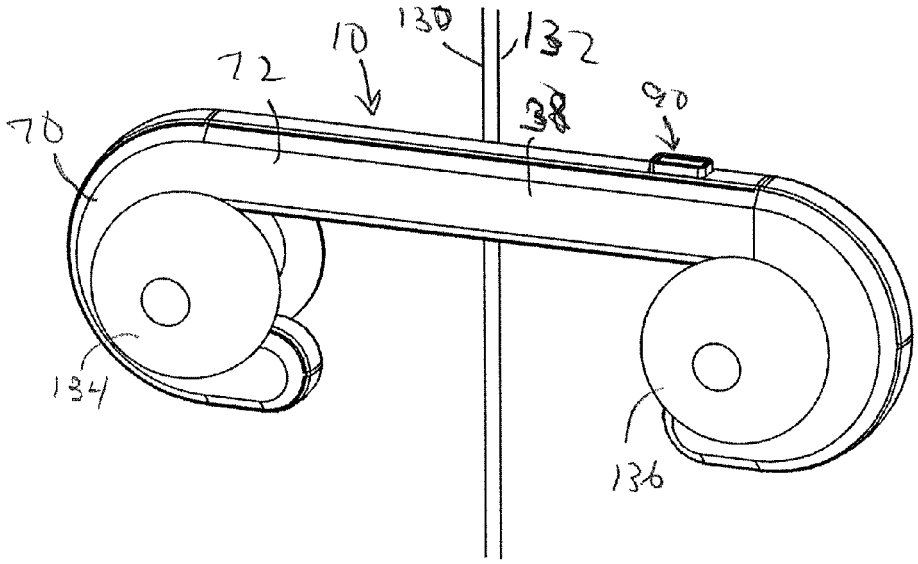
FIG. 14 is a perspective view of a security device according to one exemplary embodiment of the present disclosure in a contracted position engaging a set of double door handles.
Figure 15:
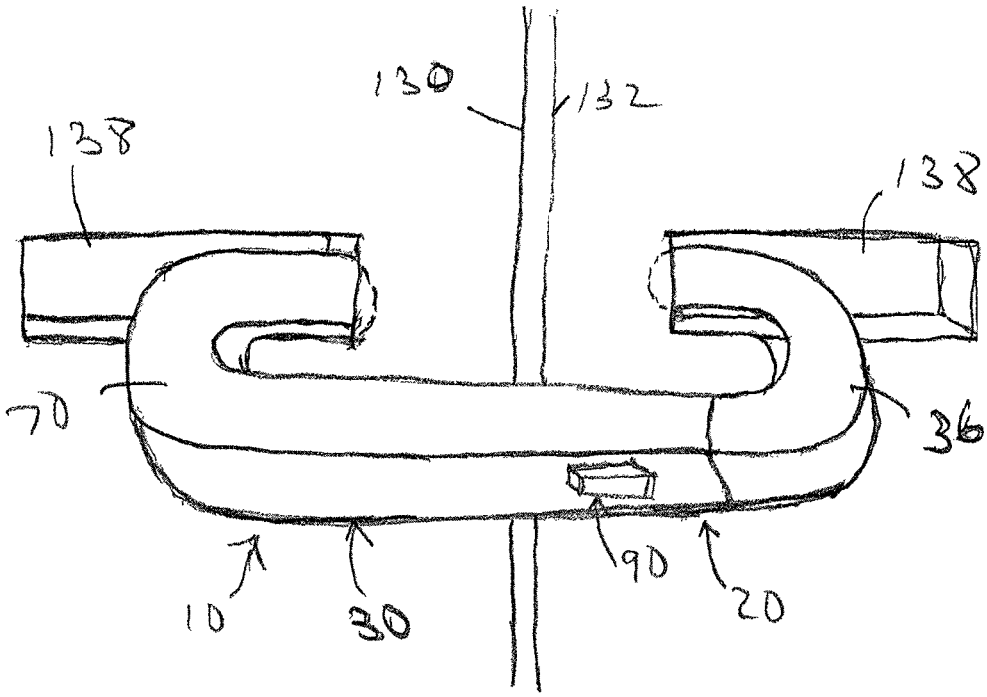
FIG. 15 is a perspective view of a security device according to one exemplary embodiment of the present disclosure in a contracted position engaging a set of double door pockets.

FIGS. 13-14 show various views of one exemplary embodiment of a security device 10 of the present disclosure in use with a double door having a first door 130, a second door 132, a first doorknob 134 and a second doorknob 136. It is to be understood that instead of a doorknob a handle, bar, or other protrusion from the door itself could be used. Alternatively, as shown in FIG. 15, portions of the first and second locking members 20, 30 of the security device of the present disclosure can be inserted within a pocket, recess or slot or hole in each of the first and second doors 130, 132. The first and second curved portions 38, 70 can be adapted in shape to be more rectangular or hook-like to be more easily insertable into a recess in the doors.

Figure 11:
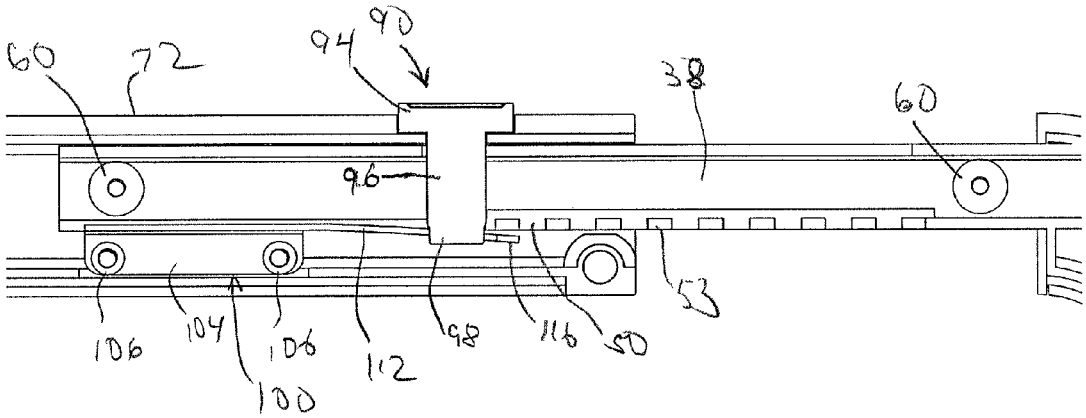
FIG. 11 is a right side elevational cutaway view of a detail of the security device illustrating the flexing of the locking prong when the release button is pressed and the security device is in a extended configuration.
Figure 12:
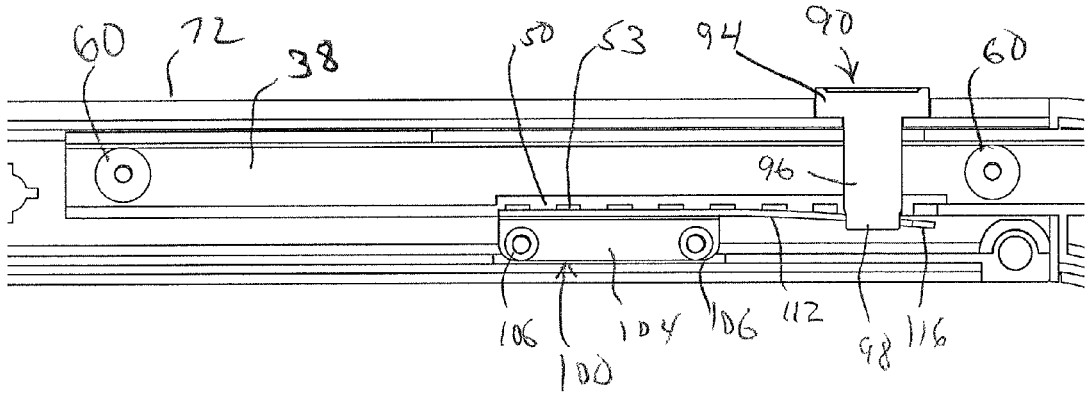
FIG. 12 is a right side elevational cutaway view of a detail of the security device illustrating the flexing of the locking prong when the release button is pressed and the security device is in a contracted configuration.

In use, the security device 10 has an extended unlocked configuration as shown in FIGS. 4, 6, 8, 11 and 13 and a telescoped locked configuration, as shown in FIGS. 3, 7, 9, 12, and 14. The security device 10 can be initially provided in either configuration. If provided in a telescoped locked configuration, a user can extend the security device 10, i.e., widen the distance between the first and second locking members 20, 30, by pressing the release button 90. The release button post 96 slides in the slot 76 and urges the locking prong 100 downward and away from the gap 52 and the rows of teeth 46, 48 (as shown in FIGS. 11-12), thereby disengaging the T-shaped end 116 from the notch 53 in the rows of teeth 46, 48, as shown in FIGS. 11-12. This enables the male portion 38 to slide at least partially out of the female portion 72. The distal end of the slot 42 in the male portion 38 prevents the release button 90 from sliding past end of the male locking portion 38, thereby preventing complete removal/separation of the first and second locking members 20, 30. Releasing the release button 90 causes the locking prong 100 to be urged upward and against the bottom of the male portion 38 that may or may not be proximate to the rows of teeth 46, 48.

With the first and second locking members 20, 30 now separated, the user can hook each curved portion 36, 70 around one or the other of the first and second door doorknobs 134, 136 (assuming the doors are closed). Alternatively, the first and second curved portions 36, 70 can be inserted into pockets 138 in the doors 130, 132. To collapse/telescope the first and second locking members 20, 30 the user presses the release button 90, urging the locking prong 100 away from engagement with the teeth 50 and thereby allowing the male portion 38 to slide within the female portion 72. When the desired overall length of the security device is reached so that the doors are maintained as closed and locked, the user releases the release button 90 so that the locking prong 100 re-engages the teeth 50 and the T-shaped end 116 is engaged in a gap 52, thus preventing the first and second locking members 20, 30 from separating.

Figure 16:
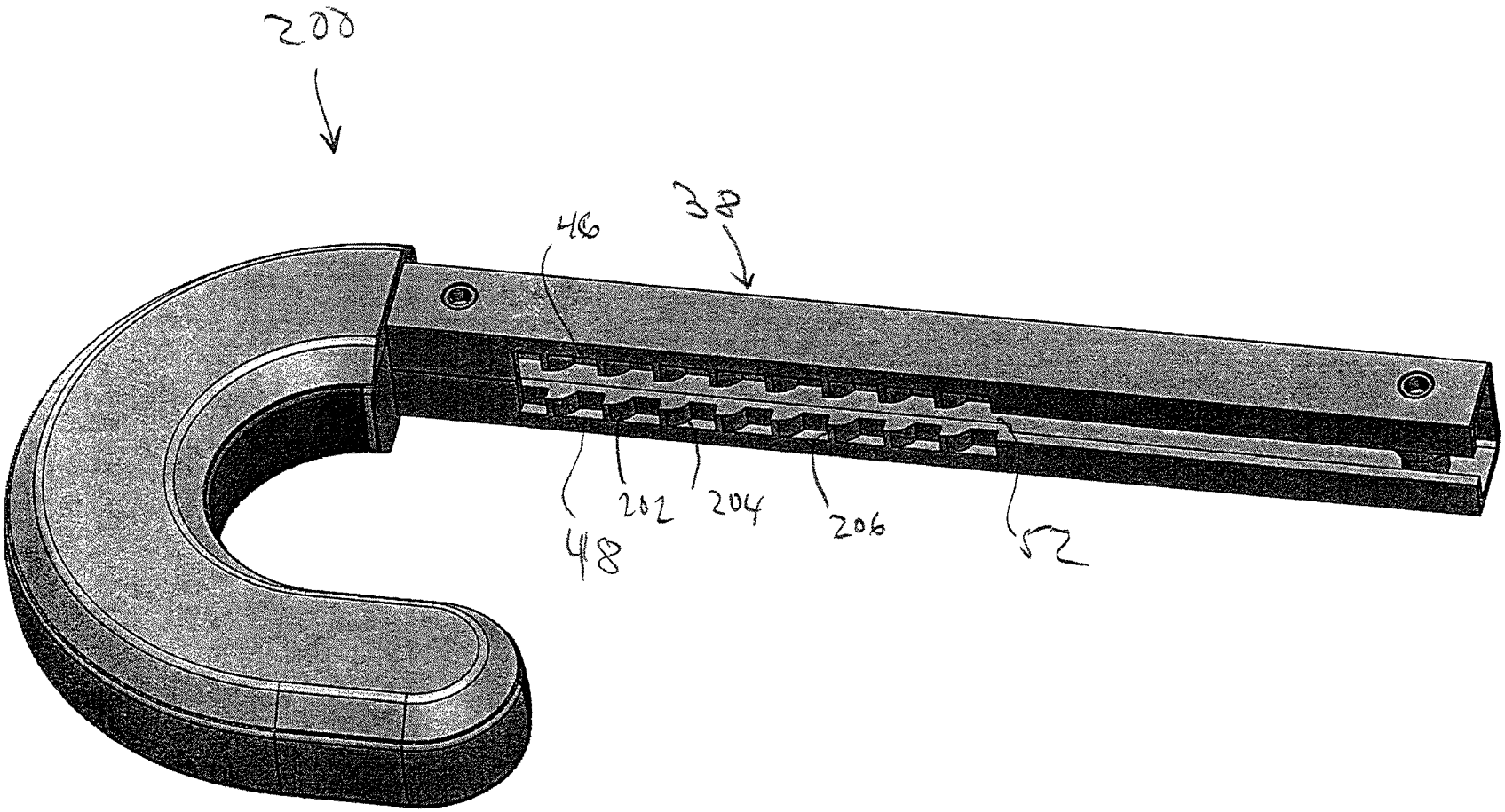
FIG. 16 is a detailed perspective view of according to an alternative exemplary embodiment of a security device featuring curved teeth.

In an alternative exemplary embodiment, shown in FIG. 16, a portion of a security device 200 can have teeth 202 which, rather than being rectangular, can have one wall 204 curved or angled (the leading wall, when the locking prong is slid so as to collapse the security device) so that the T-shaped end 116 of the locking prong 100 can flex and slide over the curved or angled wall 204 of the teeth 202 when collapsing the security device 200, even if the release button 90 is not pressed, yet the opposing, steep side (trailing) wall 206 of the tooth 202 would prevent movement in the other direction of the locking prong 100 until the release button 90 is pressed.

Figure 17:
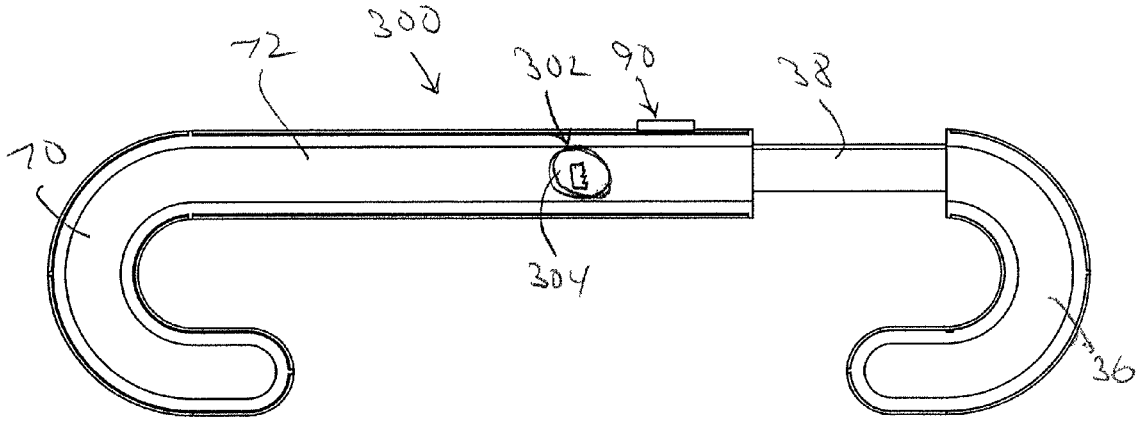
FIG. 17 is a side elevational view of an alternative exemplary embodiment of a security device in which a key lock is incorporated.
Figure 18:
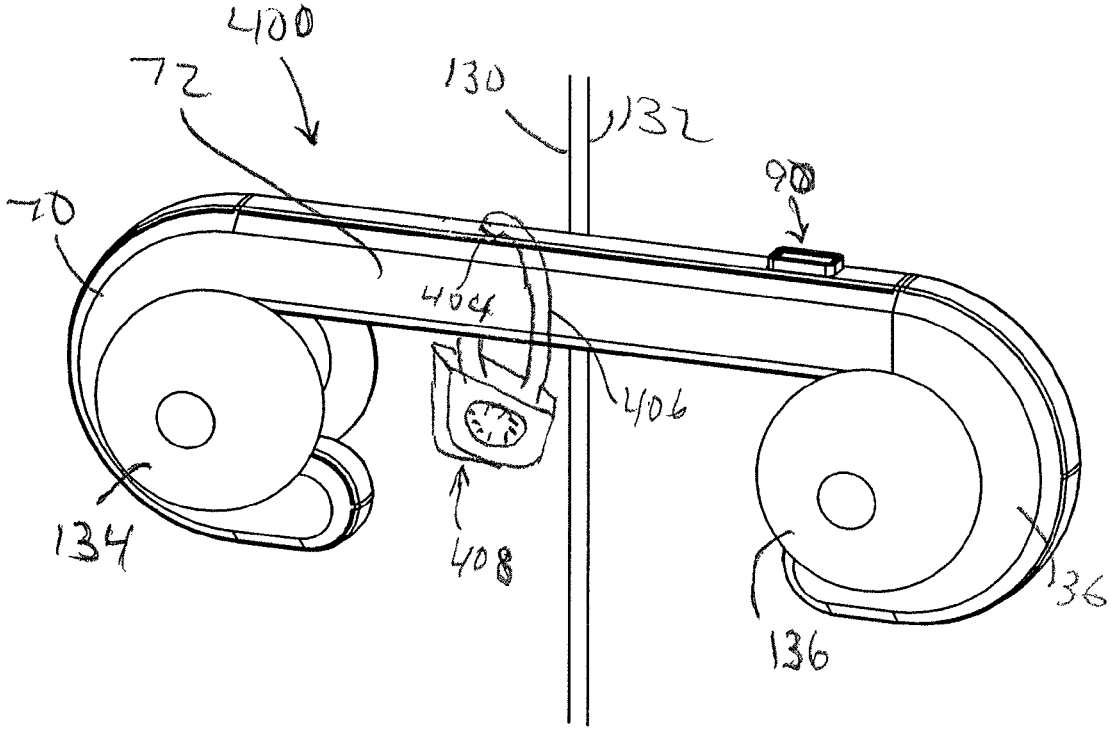
FIG. 18 is a perspective view of an alternative exemplary embodiment of a security device which can accommodate a conventional padlock.

In another alternative exemplary embodiment, a door security device 300 may have a key or combination locking mechanism 302 incorporated in the structure, as illustrated in FIG. 17. The locking mechanism 302 can have a cylinder 304 with a tab 306 (not shown) that rotates when a key (not shown) is inserted so that the male portion 38 either can or cannot be slid within the female portion 72. In a further alternative exemplary embodiment, shown in FIG. 18, a security device 400 may have a hole 402 in the top and bottom (the latter not shown) of the female portion and a hole in the top and bottom of the male members (not shown), all four holes aligning when the security device 400 is in a fully locked position so that the shackle 406 of a conventional lock 408 can be inserted in the holes 404.

It is to be understood that the presently disclosed security device can be used or adapted to be used with structures other than French doors, such as, but not limited to, truck or other vehicle double doors, fence doors, or other structures having at least one swinging or sliding door and two structures to which the hooks or hasps can be attached.

The present disclosure also provides a method of locking and maintaining as locked a double door, comprising providing a security device as described hereinabove, manipulating the security device as described hereinabove to separate the first and second locking portions, and engaging the first and second curved portions with doorknobs or pockets, and collapsing the first and second portions to maintain the security device in a locked configuration, thereby maintaining the double door as locked.

The present disclosure also provides an apparatus for controllably preventing or permitting access to a room or chamber, comprising providing two doors, each having a door handle, knob or pocket, as described hereinabove, and a security device as described hereinabove.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

It should further be noted that any patents, applications and publications referred to herein are incorporated by reference in their entirety.

What is claimed is:

1. A security device for securing a double door, the door having a first door and a second door, each door a door handle or knob, the security device comprising:

a) a first locking member having i) a first piece, ii) a second piece connectable to the first piece, iii) a first curved portion formed by a portion of the first and second pieces and having a door handle or knob engaging opening, iv) a male portion having a top side and a bottom side, the bottom side having a first row of teeth and a second row of teeth, a space between adjacent teeth defining a notch, there being a gap between the first and second rows of teeth forming a channel therethrough;

b) a second locking member lockably engageable with the first locking member and having i) a first piece, ii) a second piece connectable to the second locking member first piece, iii) a second curved portion formed by a portion of the second locking member first and second pieces, the second curved portion having a door handle or knob engaging opening facing the first locking member curved portion opening when the security device is in a locked configuration, iv) a female portion having a top side with a slot defined therein, and, v) a channel defined in the second locking member female portion sized to accommodate at least a portion of the first locking member male portion;

c) a prong release button having a top portion and a post extending therefrom, the post terminating in an engaging portion, the post being adapted to slide within the second locking member female portion slot; and d) a locking prong having a base portion adapted to engage the second locking member, a flexible finger portion including a slot defined therein, and a distal end having a tooth-engaging portion, whereby the finger portion slot is sized to accept the engaging portion of the post and at least a portion of the finger portion is adapted to flex from a straight to a curved or bent configuration, wherein the first locking member male portion is adapted to be slidingly received within the second locking member female portion channel, wherein the security device has a locked configuration in which the first locking member male portion is at least partially received within the second locking member female portion channel, whereby the locking prong finger portion can slidingly fit within the channel between the first and second rows of teeth in the male portion and such that the tooth-engaging portion engages the notch between two adjacent teeth, thereby preventing sliding movement of the first locking member with respect to the second locking member and preventing the door knobs or handles from moving away from each other, and, wherein the security device has an unlocked configuration achieved by pressing the prong release button causing the locking prong engaging portion to flex downward and causing the tooth engaging portion to disengage from the notches between the rows of teeth to permit the first locking member male portion to slide in the second locking member channel, thereby permitting disengagement of the security device from either or both door handles or knobs.

* * * * *